US009784272B2

(12) United States Patent
Honda

(10) Patent No.: US 9,784,272 B2
(45) Date of Patent: Oct. 10, 2017

(54) SCROLL-TYPE FLUID MACHINE

(71) Applicant: Sanden Holdings Corporation, Isesaki-shi, Gunma (JP)

(72) Inventor: Hiroshi Honda, Isesaki (JP)

(73) Assignee: Sanden Holdings Corporation, Isesaki-shi, Gunma (JP)

( * ) Notice: Subject to any disclaimer, the term of this patent is extended or adjusted under 35 U.S.C. 154(b) by 22 days.

(21) Appl. No.: 15/023,332

(22) PCT Filed: Sep. 18, 2014

(86) PCT No.: PCT/JP2014/074667
§ 371 (c)(1),
(2) Date: Mar. 18, 2016

(87) PCT Pub. No.: WO2015/041284
PCT Pub. Date: Mar. 26, 2015

(65) Prior Publication Data

US 2016/0230759 A1 Aug. 11, 2016

(30) Foreign Application Priority Data

Sep. 19, 2013 (JP) ..... 2013-194078

(51) Int. Cl.
*F04C 18/02* (2006.01)
*F01C 17/06* (2006.01)

(52) U.S. Cl.
CPC ..... *F04C 18/0269* (2013.01); *F01C 17/06* (2013.01); *F04C 18/0215* (2013.01); *F04C 18/0253* (2013.01)

(58) Field of Classification Search
CPC ..... F04C 18/0269; F04C 18/0215; F04C 18/0253; F01C 17/06
(Continued)

(56) References Cited

U.S. PATENT DOCUMENTS

2002/0182094 A1 12/2002 Mori et al.
2007/0178002 A1* 8/2007 Hiwata ..... F04C 18/0215 418/55.2

(Continued)

FOREIGN PATENT DOCUMENTS

JP 2002-357188 A 12/2002
JP 2008-208715 A 9/2008
JP 4745882 B2 8/2011

*Primary Examiner* — Mark Laurenzi
*Assistant Examiner* — Dapinder Singh
(74) *Attorney, Agent, or Firm* — Baker Botts L.L.P.

(57) ABSTRACT

A scroll-type fluid machine including: a scroll unit (4) having a fixed scroll (2) and a movable scroll (3) in which a bottom plate center (3*c*) and a wrap spiral center (3*d*) are made eccentric; and a rotation-inhibiting mechanism (30) with multiple rotating-inhibiting parts (33), each part (33) being composed of a circular hole (31) and a pin (32), wherein the rotation-inhibiting mechanism (30), a straight line A connecting the bottom plate center (3*c*) and the wrap spiral center (3*d*) is rotated on the bottom plate center by 90° in a direction opposite to a wrapping direction of the wrap (3*b*), a point at which the rotated straight line A intersects a pitch circle is set as a center position of one of the rotation-inhibiting parts (33), the other rotation-inhibiting parts (33) are arranged on the pitch circle at even intervals based on one of the rotation-inhibiting part (33).

7 Claims, 7 Drawing Sheets

(58) Field of Classification Search
USPC ..... 418/55.1–55.5
See application file for complete search history.

(56) References Cited

U.S. PATENT DOCUMENTS

2007/0253853 A1 11/2007 Takeuchi et al.
2010/0202911 A1* 8/2010 Ni ..... B29C 45/14065
418/55.2

* cited by examiner

SCROLL-TYPE FLUID MACHINE

CROSS-REFERENCE TO RELATED APPLICATIONS

This application is a U.S. National Stage Patent Application under 37 U.S.C. §371 of International Patent Application No. PCT/JP2014/074667, filed on Sep. 18, 2014, which claims the benefit of Japanese Patent Application No. JP 2013-194078, filed on Sep. 19, 2013, the disclosures of which are incorporated herein by reference in their entirety.

TECHNICAL FIELD

The present invention relates to a scroll-type fluid machine, and in particular, relates to a rotation-inhibiting mechanism for a movable scroll.

BACKGROUND ART

A scroll-type fluid machine includes: a scroll unit having a fixed scroll and a movable scroll, which respectively have a spiral wrap standing on a bottom plate and which are meshed with respective wraps facing each other to form sealed spaces between both scroll wraps, where while the rotation-preventing mechanism prevents the rotation of the movable scroll, the movable scroll is orbited around the shaft center of the fixed scroll to change the volumes of the sealed spaces in order to compress or expand fluid.

As the rotation-inhibiting mechanism of such a scroll-type fluid machine, for example, there is known a rotation-inhibiting mechanism described in Patent Document 1. Specifically, multiple rotation-inhibiting parts, each composed of pins provided to protrude on the movable scroll side and the housing side, respectively, and a ring engaged with both pins, are arranged in the circumferential direction of the movable scroll. In such a structure, when the movable scroll is turned about the shaft center of the fixed scroll, the pin on the movable scroll side of each of the rotation-inhibiting parts is turned around the pin on the housing side while being restricted by the ring to inhibit the rotation of the movable scroll.

REFERENCE DOCUMENT LIST

Patent Document

Patent Document 1: Japanese Patent Application Laid-open Publication No. 2008-208715

SUMMARY OF THE INVENTION

Problems to be Solved by the Invention

In the meantime, for example, in a scroll-type compressor, a rotational moment is generated in the movable scroll by a compression reaction force caused by compression, and a load of this rotational moment acts on the rotation-inhibiting parts. When the load concentrates on one rotation-inhibiting part, there arises a problem that the pins are damaged or the like. Therefore, in the rotation-inhibiting mechanism described in Patent Document 1, such an arrangement structure of multiple rotation-inhibiting parts that the load will not concentrate on one rotation-inhibiting part when the rotational moment is maximum is illustrated.

However, Patent Document 1 does not mention a case in which the spiral wrap center is made eccentric to the bottom plate center of the movable scroll in order to reduce the size of the scroll-type fluid machine (to reduce the body diameter of the compressor). When the spiral wrap center is made eccentric to the bottom plate center of the movable scroll, distance from the bottom plate center of the movable scroll to the center of the compression reaction force acting on the movable scroll during one turn of the movable scroll changes to vary the rotational moment generated depending on the turning position of the movable scroll even if the compression reaction force is constant. Therefore, as for a scroll-type fluid machine in which the spiral wrap center is made eccentric to the bottom plate center of the movable scroll to achieve downsizing, it is important to determine the arrangement of rotation-inhibiting parts in consideration of the variation in the rotational moment depending on the turning position of the movable scroll as well to reduce the load acting on the rotation-inhibiting parts in order to improve the durability of the rotation-inhibiting mechanism.

The present invention has been made by focusing attention on the above problems, and it is an object thereof to provide a scroll-type fluid machine capable of downsizing the scroll-type fluid machine and improving the durability of a rotation-inhibiting mechanism.

Means for Solving the Problems

A scroll-type fluid machine of the present invention includes: a scroll unit including a fixed scroll and a movable scroll, which respectively have a spiral wrap standing on a bottom plate with a spiral center of the wrap eccentric to a center of the bottom plate and which are meshed with respective wraps facing each other to form sealed spaces; and a rotation-inhibiting mechanism in which at least three or more rotation-inhibiting parts are arranged in the circumferential direction of the movable scroll, each rotation-inhibiting part being composed of a circular hole formed in either one of a back face of the bottom plate of the movable scroll and a housing wall facing the back face, and a pin protruding on the other in a form of being engaged with the circular hole, where while the rotation-inhibiting mechanism inhibit the rotation of the movable scroll, the movable scroll is orbited around a shaft center of the fixed scroll to change the volumes of the sealed spaces, wherein in the rotation-inhibiting mechanism, at least one of the rotation-inhibiting parts is arranged to locate the center of the circular hole on a straight line extending perpendicularly to a straight line connecting the bottom plate center of the movable scroll and the spiral center of the wrap and passing through the bottom plate center.

Effects of the Invention

According to the scroll-type fluid machine of the present invention, at least one of three or more pin-and-hole type rotation-inhibiting parts is arranged to locate the center of the circular hole on the straight line extending perpendicularly to the straight line connecting the bottom plate center of the movable scroll and the spiral center of the wrap and passing through the bottom plate center. In the scroll-type fluid machine in which the bottom plate center of the movable scroll and the wrap spiral center are made eccentric to each other, distance from the bottom plate center of the movable scroll to the rotation-inhibiting part becomes longest when distance from the bottom plate center to the center of a compression reaction force during one turn of the movable scroll is maximum. Therefore, the load of a rotational moment generated by the movable scroll and acting on the pin of the rotation-inhibiting part can be reduced, and hence the durability of the rotation-inhibiting mechanism can be improved while downsizing the scroll-type fluid machine.

MODE FOR CARRYING OUT THE INVENTION

An embodiment of the present invention will be described in detail below. Although a scroll-type fluid machine according to the present invention can be used as a compressor or an expander, an example of the compressor is described here.

Figure 1:
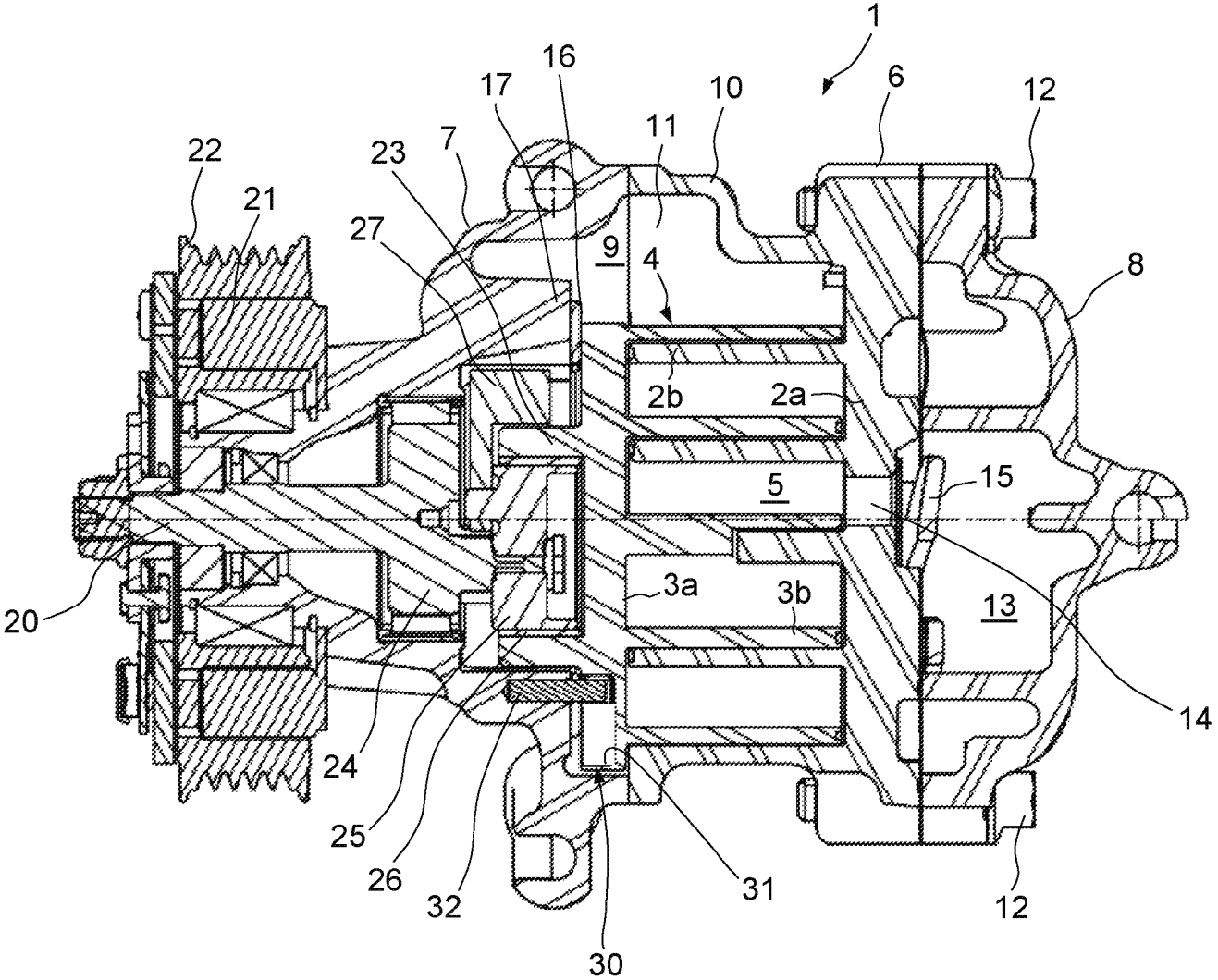
FIG. 1 is a front view of a scroll-type compressor illustrating an embodiment of the present invention.
Figure 2:
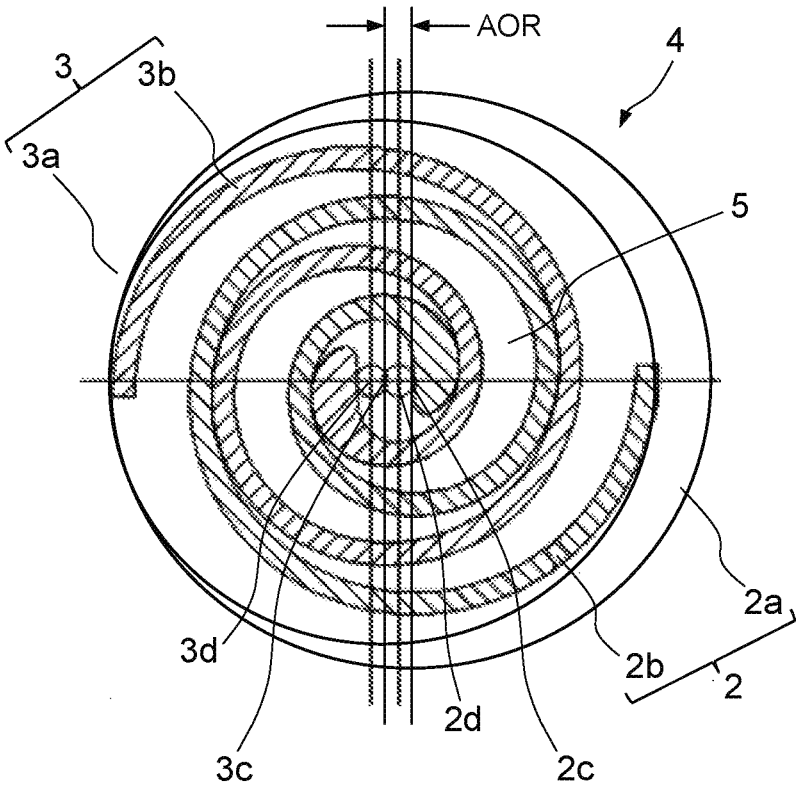
FIG. 2 is an explanatory view of a scroll unit.
Figure 3:
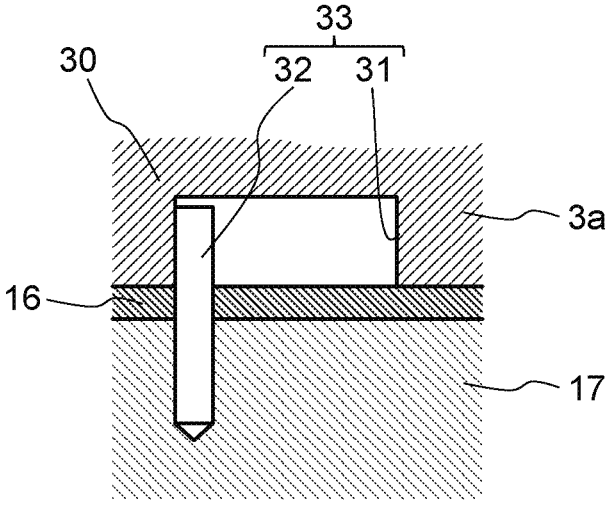
FIG. 3 is an enlarged sectional view of a rotation-inhibiting part of a rotation-inhibiting mechanism.
Figure 4:
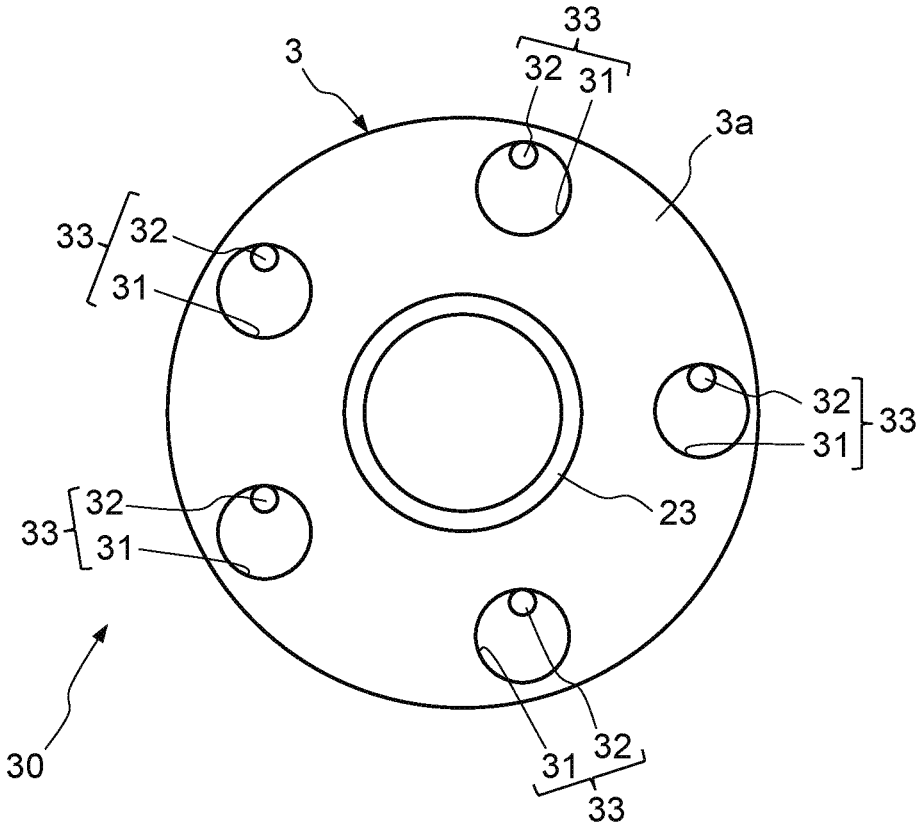
FIG. 4 is an arrangement plan of rotation-inhibiting parts of the rotation-inhibiting mechanism on a bottom plate of a movable scroll.

FIG. 1 to FIG. 4 illustrate the structure of a scroll-type compressor of the embodiment, in which FIG. 1 is a sectional view illustrating the general structure, FIG. 2 is an explanatory view of a scroll unit. FIG. 3 is an enlarged sectional view of an rotation-inhibiting part that constitutes part of a rotation-inhibiting mechanism, and FIG. 4 is an arrangement plan of rotation-inhibiting parts of the rotation-inhibiting mechanism on a bottom plate of the movable scroll.

A scroll-type compressor 1 includes a scroll unit 4 having a fixed scroll 2 and a movable scroll 3 arranged to face each other in the center axis direction. As illustrated in FIG. 2, the fixed scroll 2 has a spiral wrap 2*b* standing on a bottom plate 2*a* in an integrated manner. Likewise, the movable scroll 3 has a spiral wrap 3*b* standing on a bottom plate 3*a* in an integrated manner. Both wraps 2*b* and 3*b* have the shape of an involute curve or a curve approximate to an involute, where the wrap 2*b* of the fixed scroll 2 is so formed that a spiral center 2*d* (the center of an involute base circle, which is called a fixed spiral center below) is made eccentric to a bottom plate center 2*c* of the fixed scroll 2. Further, the wrap 3*b* of the movable scroll 3 is so formed that a spiral center 3*d* (the center of an involute base circle, which is called a movable spiral center below) is made eccentric to a bottom plate center 3*c* of the movable scroll 3. This can reduce the outer diameter of the scroll unit 4 and hence the body diameter of the scroll-type compressor 1, enabling reduction in size of the scroll-type compressor 1.

Both scrolls 2 and 3 are so arranged that both wraps 2*b* and 3*b* are meshed to bring a protruding-side edge of the wrap 2*b* of the fixed scroll 2 into contact with the bottom plate 3*a* of the movable scroll 3 and a protruding-side edge of the wrap 3*b* of the movable scroll 3 into contact with the bottom plate 2*a* of the fixed scroll 2. Note that a chip seal is provided on the protruding-side edge of each of both wraps 2*b* and 3*b*.

Further, both scrolls 2 and 3 are so arranged that side walls of both wraps 2*b* and 3*b* come into partial contact with each other in a state in which the angles of both wraps 2*b* and 3*b* in the circumferential direction are deviated from each other. Thus, fluid pockets 5 as crescent-shaped sealed spaces are formed between both wraps 2*b* and 3*b*.

The movable scroll 3 is assembled in such a manner to make the bottom plate center 3*c* (shaft center) eccentric to the bottom plate center 2*c* (shaft center) of the fixed scroll 2. The movable scroll 3 is orbited by a drive mechanism around the bottom plate center 2*c* of the fixed scroll 2 with a turning radius AOR defined by contact between both wraps 2*b* and 3*b* while inhibiting the rotation thereof by a rotation-inhibiting mechanism 30 to be described later. This causes the fluid pockets 5 formed between both wraps 2*b* and 3*b* to move from the outer end portions of the wraps 2*b* and 3*b* toward the center portions while contacting between both wraps 2*b* and 3*b* so that the volumes of the fluid pockets 5 are changed in a direction to reduce the volumes. Therefore, fluid (e.g. refrigerant gas) taken from the outer end side of the wraps 2*b* and 3*b* into the fluid pockets 5 is compressed.

In the case of an expander, the fluid pockets 5 are moved reversely from the central portions toward the outer end portions of the wraps 2*b* and 3*b* to change the volumes of the fluid pockets 5 in a direction to increase the volumes so that the fluid taken from the center side of the wraps 2*b* and 3*b* into the fluid pockets 5 are expanded.

A housing of the scroll-type compressor 1 is composed of a center housing 6 containing the scroll unit 4, a front housing 7 arranged on the front side of the center housing 6, and a rear housing 8 arranged on the rear side of the center housing 6.

In the embodiment, the center housing 6 is formed integrally with the fixed scroll 2 as a housing part (outer shell) of the scroll unit 4. Note that the fixed scroll 2 and the center housing 6 may be constructed as separate embers in such a manner to house and fix the fixed scroll 2 in and to the center housing 6. The rear side of the center housing 6 is closed by the bottom plate 2*a*, and the front side thereof is open.

The front housing 7 is fastened by bolts (not illustrated) to the opening side of the center housing 6. The front housing 7 supports the movable scroll 3 in the thrust direction and houses a drive mechanism of the movable scroll 3.

In the front housing 7, a suction chamber 9 for the fluid mentioned above, which is connected to a suction port (not illustrated) formed in the outer wall of the front housing 7, is internally formed.

In the front housing 7 and the center housing 6, a bulged part 10 is partially formed in the circumferential direction. Inside the bulged part 10, a fluid passage space 11 is formed to extend in a direction parallel to the central shaft of the compressor. The fluid passage space 11 guides the above-mentioned fluid from the suction chamber 9 on the side of the front housing 7 to the vicinity of the outer ends of both wraps 2*b* and 3*b* of the scroll unit 4 on the side of the center housing 6.

The rear housing 8 is fastened by bolts 12 to the center housing 6 on the side of the bottom plate 2*a* to form a discharge chamber 13 for the above-mentioned fluid between the rear housing 8 and the back face of the bottom plate 2*a*. In a central portion of the bottom plate 2*a* of the fixed scroll 2, a discharge hole 14 for compressed fluid is formed, and a one-way valve 15 is attached to the discharge hole 14. The discharge hole 14 is connected to the discharge chamber 13 through the one-way valve 15. The discharge chamber 13 is connected to a discharge port (not illustrated) formed in the outer wall of the rear housing 8.

The above-mentioned fluid is introduced from the suction port into the suction chamber 9 in the front housing 7, taken from the outer end side of the scroll unit 4 into the fluid pockets 5 formed by contact between the wraps 2*b* and 3*b* via the fluid passage space 11 inside the bulged part 10 of the front housing 7 and the center housing 6, and subjected to compression. The compressed fluid is discharged from the discharge hole 14 bored in the central portion of the bottom plate 2*a* of the fixed scroll 2 to the discharge chamber 13 inside the rear housing 8, and guided therefrom and output to the outside through the discharge port.

The front housing 7 has a thrust receiving part 17 inside an outer circumferential part fastened by bolts (not illustrated) to the opening side of the center housing 6 to face the back face of the bottom plate 3*a* of the movable scroll 3 in order to receive a thrust force from the movable scroll 3 through a thrust plate 16.

Further, the front housing 7 rotatably supports, in a central portion, a drive shaft 20 as the core of the drive mechanism of the movable scroll 3. One end side of the drive shaft 20 protrudes outside the front housing 7, and a pulley 22 is attached there through an electromagnetic clutch 21. Thus, the drive shaft 20 is driven to rotate by a rotation driving force input from the pulley 22 through the electromagnetic clutch 21. The other end side of the drive shaft 20 is coupled to the movable scroll 3 through a crank mechanism.

In the embodiment, the crank mechanism includes a cylindrical boss part 23 formed to protrude from the back face of the bottom plate 3*a* of the movable scroll 3, and an eccentric bush 25 attached eccentrically to a crank 24 provided at an end of the drive shaft 20, where the eccentric bush 25 is fitted in the boss part 23 through a shaft bearing 26. Note that a balancer weight 27 is attached to the eccentric bush 25 to counterbalance a centrifugal force during the operation of the movable scroll 3.

As illustrated in FIG. 4, the rotation-inhibiting mechanism 30 is constructed by arranging multiple rotation-inhibiting parts 33 (five in the embodiment) at even intervals along the circumferential direction in the neighborhood of the outer edge of the back face of the bottom plate 3*a* of the movable scroll 3, where each of the rotation-inhibiting parts 33 is composed of a circular hole 31 formed in the back face of the bottom plate 3*a* of the movable scroll 3 (to face the thrust receiving part 17 of the front housing 7), and a pin 32 protruding on the side of the thrust receiving part 17 of the front housing 7 through the thrust plate 16 in a form of being engaged with the circular hole 31 as illustrated in the enlarged sectional view of FIG. 3. If there are at least three or more rotation-inhibiting parts 33, the movable scroll 3 can orbit around the shaft center of the fixed scroll 2 without rotating.

The operation of the scroll-type compressor 1 having such a structure is described in brief.

When the pulley 22 is rotated by a rotation driving force from the outside, the drive shaft 20 rotates through the electromagnetic clutch 21 to cause the movable scroll 3 to orbit around the shaft center of the fixed scroll 2 through the crank mechanism while inhibiting the rotation by the rotation-inhibiting mechanism 30. By the orbiting motion of the movable scroll 3, fluid (refrigerant gas) is taken from the suction port into the fluid pockets 5 between the wraps 2*b* and 3*b* of the scroll unit 4 via the suction chamber 9 and the fluid passage space 11, and fluid compressed by a change in reduction of the volumes of the fluid pockets 5 is discharged from the discharge hole 14 in the central portion of the fixed scroll 2 to the discharge chamber 13. The fluid discharged to the discharge chamber 13 is guided and output to the outside through the discharge port.

Next, the rotation-inhibiting mechanism 30 of the embodiment is described in detail.

Figure 5A:
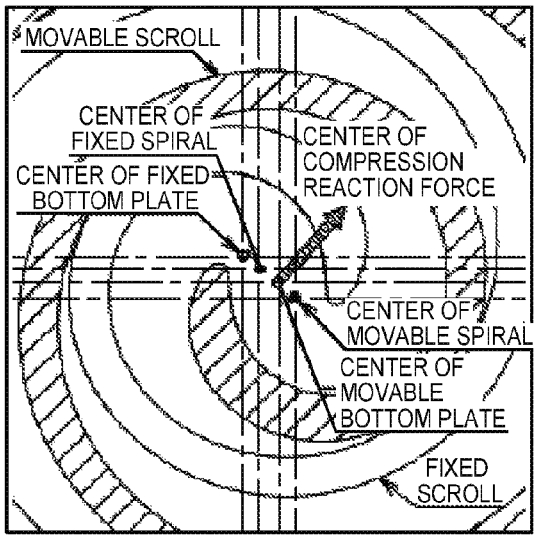
FIG. 5 is an explanatory view of variations in distance between the center of a compression reaction force and the bottom plate center of the movable scroll during a turn of the movable scroll.
Figure 5B:
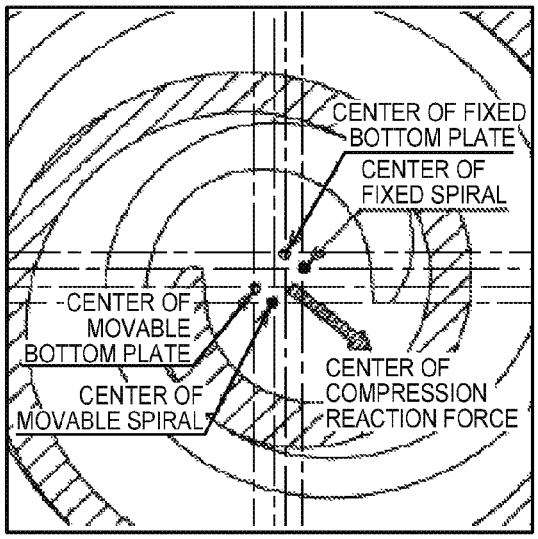
Figure 5C:
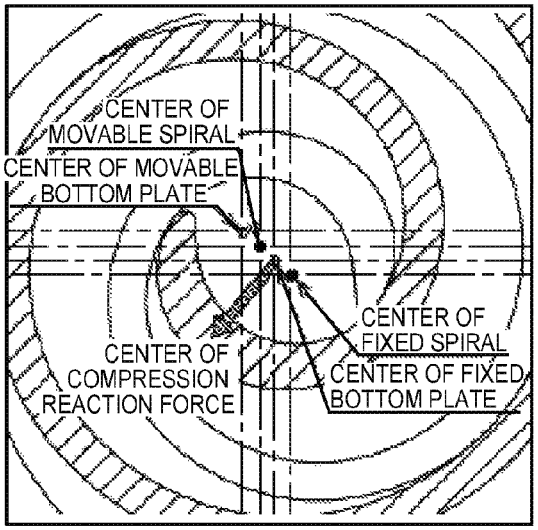
Figure 5D:
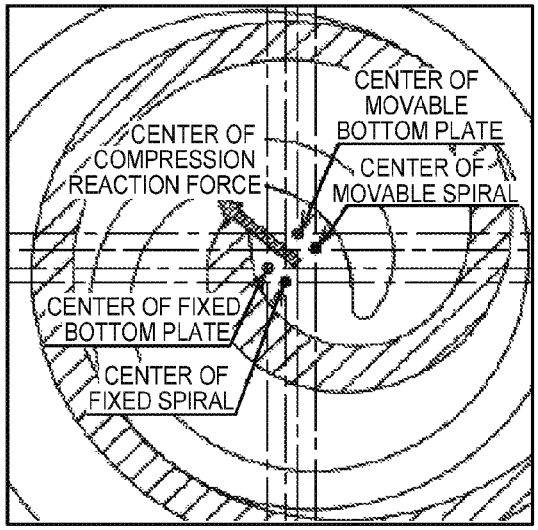

As mentioned above, in the scroll-type fluid machine 1 of the embodiment, the bottom plate center 3*c* of the movable scroll 3 and the movable spiral center 3*d* of the wrap 3*b* are made eccentric to each other. In this case, as illustrated in FIG. 5, distance between the center of a compression reaction force that acts on the movable scroll 3 and the bottom plate center 3*c* of the movable scroll 3 changes during one turn of the movable scroll 3. Therefore, the rotational moment generated in the movable scroll 3 varies even when the compression reaction force is constant during one turn of the movable scroll 3. FIG. 5 is an explanatory view of distance changes between the center of the compression reaction force and the bottom plate center 3*c* of the movable scroll 3 during the turn of the movable scroll, where FIG. 5A illustrates the position of the movable scroll when the distance between the center of the compression reaction force and the movable bottom plate center 3*c* is shortest, and FIG. 5B illustrates a state of turning 90° from the position of the movable scroll in FIG. 5A in the wrapping direction of the wrap 3*b*. FIG. 5C illustrates a state of turning 180° from the position of the movable scroll in FIG. 5A in the wrapping direction of the wrap 3*b*, indicating the position of the movable scroll at which the distance between the center of the compression reaction force and the movable bottom plate center 3*c* is longest. FIG. 5D illustrates a state of turning 270° from the position of the movable scroll in FIG. 5A in the wrapping direct on of the wrap 3*b*. Note that the center of the compression reaction force is a midpoint between the fixed spiral center 2*d* and the movable spiral center 3*d* because of a power relationship existing between the wraps 2*b* and 3*b* by the compressed fluid in the fluid pockets 5 of the scroll unit 4.

The distance between a rotation-inhibiting part, which receives a load caused by the rotational moment generated in the movable scroll 3, and the bottom plate center 3*c* of the movable scroll 3 also varies during one turn of the movable scroll 3. In the rotation-inhibiting mechanism 30 of the embodiment, even when the bottom plate centers 2*c* and 3*c* of both scrolls 2 and 3 are misaligned in the manufacturing and assembling of the fixed scroll 2 and the movable scroll 3, an allowable turning radius POR of the movable scroll 3 defined by a gap between the circular hole 31 and the pin 32 of each rotation-inhibiting part 33 of the rotation-inhibiting mechanism 30 is set larger than the turning radius AOR defined by contact between the wrap 2*b* of the fixed scroll 2 and the wrap 3*b* of the movable scroll 3 (AOR<POR) to ensure the contact between the wrap 2*b* of the fixed scroll 2 and the wrap 3*b* of the movable scroll 3.

Figure 6A:
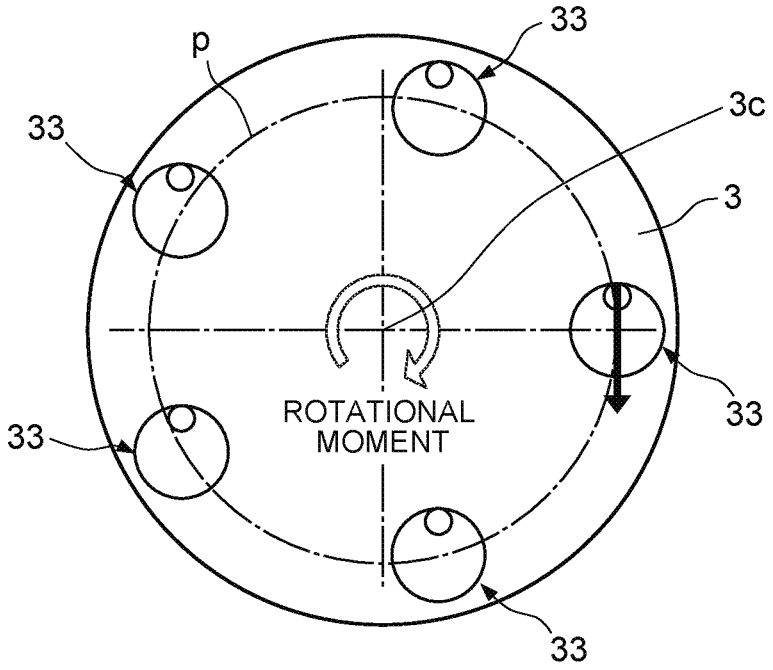
FIG. 6 is an explanatory view of variations in distance from the bottom plate center of the movable scroll to the rotation-inhibiting parts during a turn of the movable scroll.

Thus, when the turning radius AOR defined by contact between the wrap 2*b* and the wrap 3*b*, and the allowable turning radius POR of the movable scroll 3 defined by the gap between the circular hole 31 and the pin 32 of the rotation-inhibiting part 33 bear the relationship AOR<POR, even if multiple rotation-inhibiting part 33 (five in the figure) are arranged, one rotation-inhibiting part 33 takes charge of a rotation-inhibiting force (equivalent to the load of the rotational moment acting on the pin 32) to inhibit the rotation of the movable scroll 3 as illustrated in FIG. 6A.

Figure 6B:
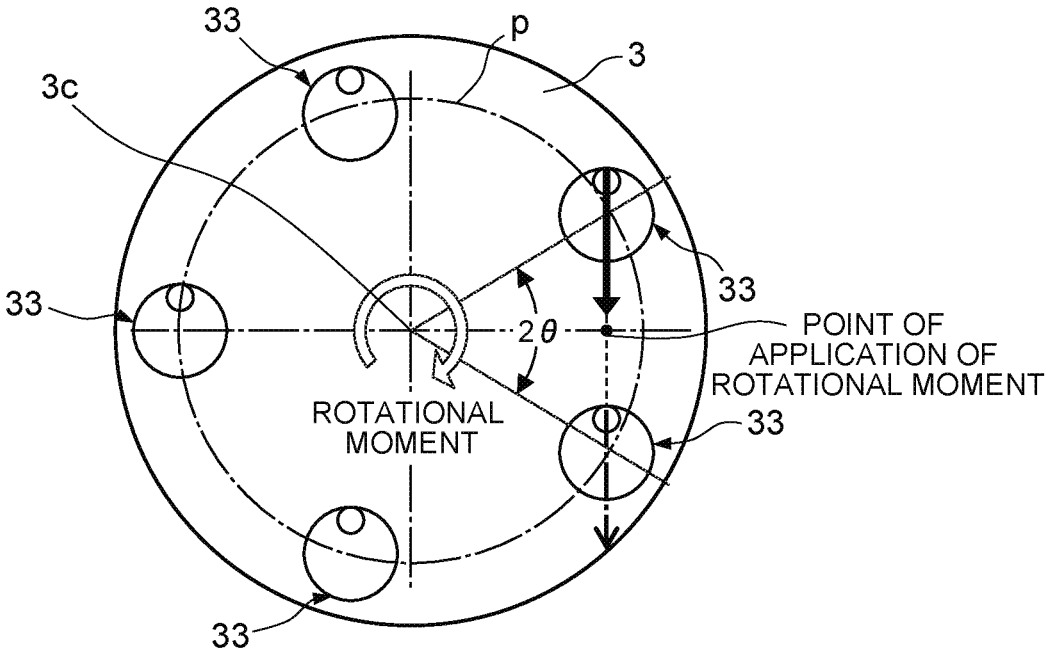

However, as illustrated in FIG. 6B, two rotation-inhibiting parts 33 take charge of the rotation-inhibiting force momentarily during transition to another rotation-inhibiting part 33 in charge of the rotation-inhibiting force. Therefore, under the constant rotational moment, when the load of the rotational moment is received by one rotation-inhibiting part 33 as in FIG. 6A, the distance from the bottom plate center 3*c* (rotation center) of the movable scroll 3 to the rotation-inhibiting part 33 in charge of the rotation-inhibiting force is longest, and the rotation-inhibiting force by the rotation-inhibiting part 33 becomes smallest. Further, as in FIG. 6B, when two rotation-inhibiting parts 33 take charge of the rotation-inhibiting force, the distance from the bottom plate center 3*c* (rotation center) of the movable scroll 3 to the point of application of the rotational moment is shortest, and the rotation-inhibiting force by the rotation-inhibiting part 33 becomes largest. Thus, the distance from the bottom plate center 3*c* (rotation center) of the movable scroll 3 to the point of application of the rotational moment also varies during one turn of the movable scroll 3. In FIG. 6, p denotes a rotation-inhibiting pitch circle indicative of the center of each rotation-inhibiting part 33 of the rotation-inhibiting mechanism 30, which is a pitch circle having the bottom plate center 3*c* of the movable scroll 3 as its center and the length from the bottom plate center 3*c* to the center of the circular hole 31 as its radius. Note that the boss part 23 in the movable scroll 3 is not illustrated in FIG. 6 for the sake of simplification.

The scroll-type fluid machine 1 of the embodiment determines the placement of each of the rotation-inhibiting parts 33 in the circumferential direction of the movable scroll in consideration of the above-mentioned variation in the rotational moment and variation in the distance from the bottom plate center 3*c* (rotation center) of the movable scroll 3 to the point of application of the rotational moment during one turn of the movable scroll 3 so that the distance from the bottom plate center 3*c* of the movable scroll 3 to the rotation-inhibiting part 33 becomes longest at a position of the movable scroll where the distance between the center of the compression reaction force and the bottom plate center 3*c* of the movable scroll 3 is maximum during one turn of the movable scroll 3. Specifically, at least one of the rotation-inhibiting parts 33 is placed on a straight line extending perpendicularly to a straight line connecting the bottom plate center 3*c* of the movable scroll 3 and the movable spiral center 3*d* (the spiral center of the wrap 3*b*) and passing through the bottom plate center.

A specific procedure for arranging the rotation-inhibiting parts 33 of the embodiment is described with reference to FIGS. 7A to 7C. Note that, in FIGS. 7A to 7C, the left side indicates the wrap standing side of the bottom plate 3*a* of the movable scroll 3, and the right side indicates the back face side of the bottom plate 3*a* of the movable scroll 3 as the side of forming the circular hole 31.

Figure 7A:
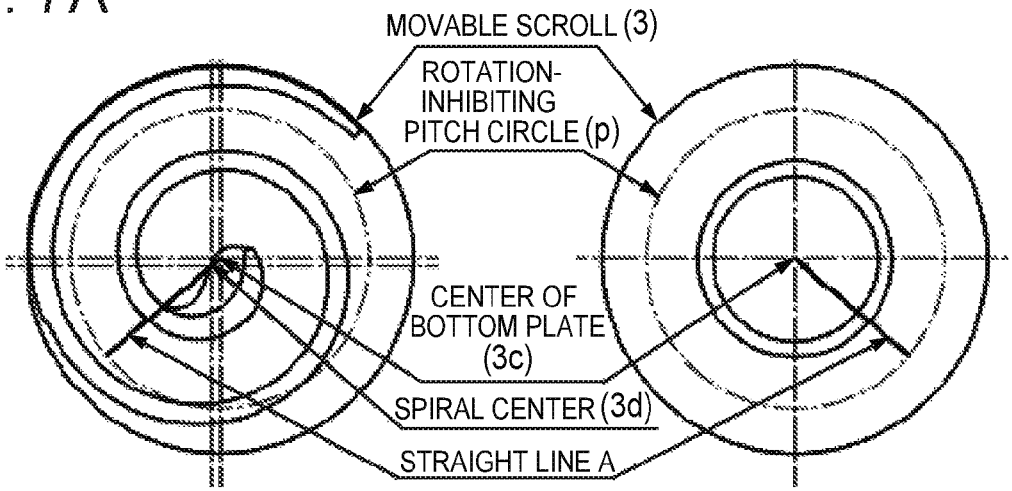
FIG. 7 is an explanatory view of a procedure for arranging the rotation-inhibiting parts of the embodiment.

First, as illustrated in FIG. 7A, a straight line A is drawn from the bottom plate center 3*c* of the movable scroll 3 toward the movable spiral center 3*d* (the spiral center of the wrap 3*b*) up to the rotation-inhibiting pitch circle.

Next, the above straight line A is rotated on the bottom plate center 3*c* of the movable scroll 3 by 90° in a direction opposite to the wrapping direction of the wrap 3*b*, and a point at which the rotated straight line A intersects the rotation-inhibiting pitch circle p having the bottom plate center 3*c* as its center and the length from this bottom plate center 3*c* to the center of the circular hole 31 as its radius is set as the center position of the first rotation-inhibiting part 33.

Figure 7B:
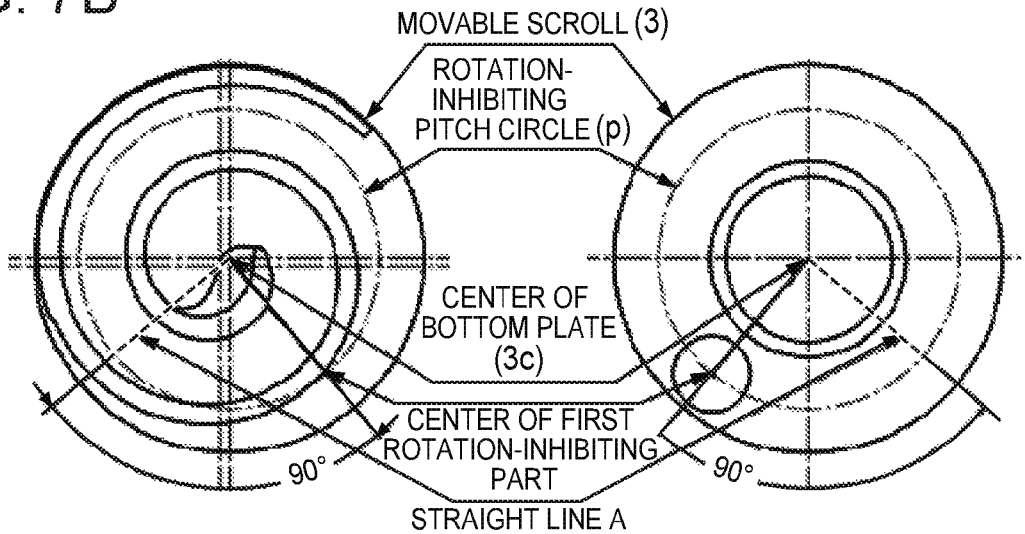
Figure 7C:
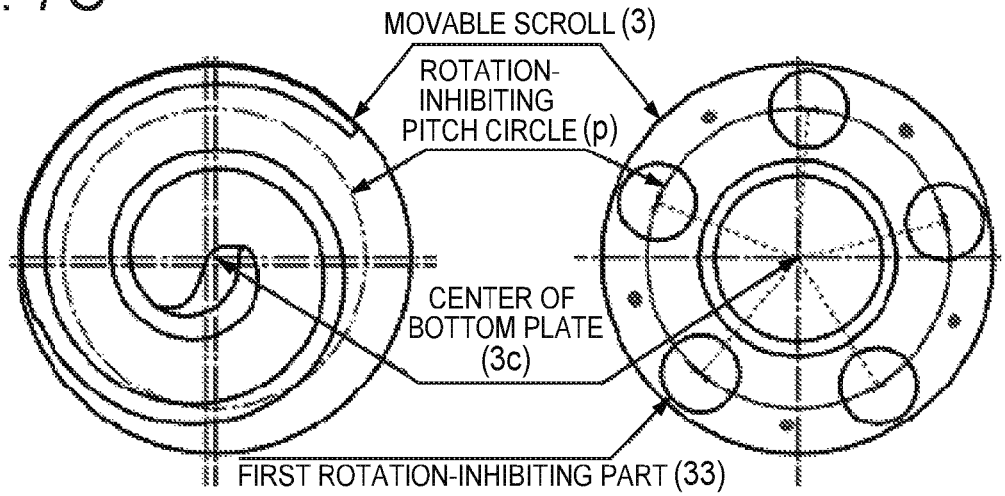
Figure 8A:
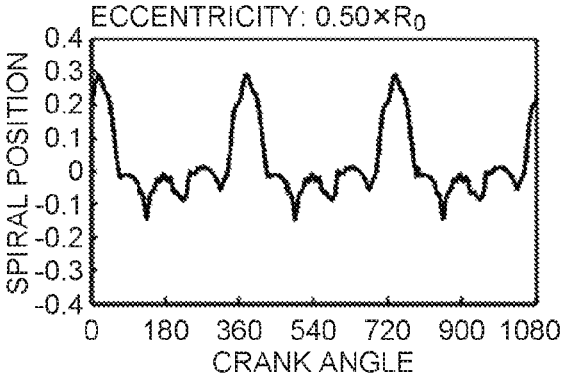
FIG. 8 is a chart illustrating the analysis results of the posture of the movable scroll when the eccentricity of the bottom plate center of the movable scroll and the spiral center of a wrap is changed.
Figure 8B:
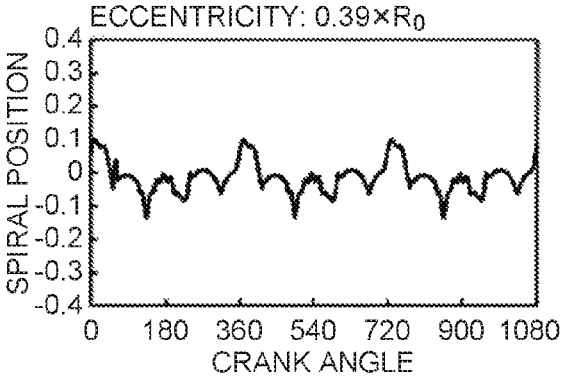
Figure 8C:
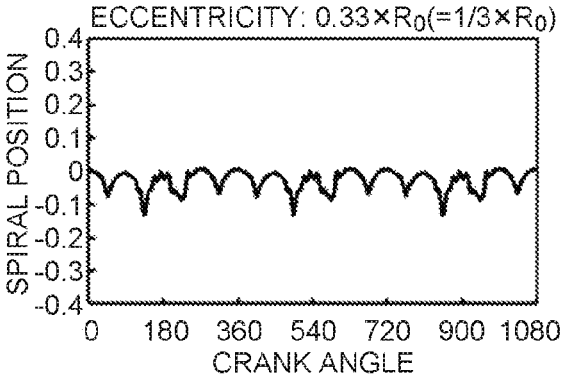
Figure 8D:
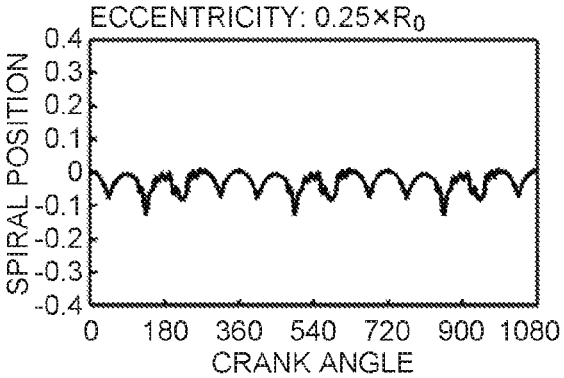
Figure 8E:
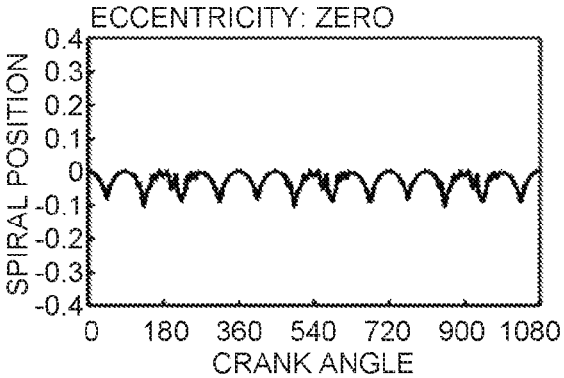

Next, the center positions of the other rotation-inhibiting parts 33 are placed on the rotation-inhibiting pitch circle p at even intervals based on the center point B of the rotation-inhibiting part 33 determined in FIG. 7B mentioned above.

According to such a scroll-type fluid machine 1 of the embodiment, the load of the rotational moment generated by the movable scroll 3 and acting on the rotation-inhibiting part 33 when the bottom plate center 3*c* of the movable scroll 3 and the spiral center 3*d* of the wrap 3*b* are made eccentric to each other can be reduced, and hence the durability of the rotation-inhibiting mechanism 30 can be improved while reducing the size of the scroll-type fluid machine 1.

FIGS. 8A to 8E illustrate the analysis results of the posture (spiral posture) of the movable scroll 3 when the eccentricity of the bottom plate center 3*c* of the movable scroll 3 and the spiral center 3*d* of the wrap 3*b* is changed. Note that the case of an eccentricity of 0 is also illustrated for reference.

When the turning radius of the movable scroll 3 having the shaft center of the fixed scroll 2 as its center is denoted by R0, the posture of the movable scroll 3 is stabilized and the movable scroll 3 starts turning smoothly by setting the eccentricity of the bottom plate center 3*c* of the movable scroll 3 and the spiral center 3*d* of the wrap 3*b* to ⅓ or of the turning radius R0 from FIG. 8. Thus, if the eccentricity of the bottom plate center 3*c* of the movable scroll 3 and the spiral center 3*d* of the wrap 3*b* is set to ⅓ or less of the turning radius R0, noise can be reduced by the smooth turning motion of the movable scroll 3.

In the rotation-inhibiting mechanism 30 of the embodiment, the circular hole 31 is formed on the side of the movable scroll 3 and the pin 32 is protruding on the side of the front housing 7, but the structure may also be such that the circular hole 31 is formed on the side of the front housing 73 and the pin 32 protruding on the side of the movable scroll 3. In this case, however, since the protruding length of the pin 32 is restricted by the thickness of the bottom plate 3*a* of the movable scroll 3, there is a need to make the bottom plate 3*a* of the movable scroll 3 thick enough to avoid the risk of causing the pin 32 to fall out, and this leads to an increase in the weight of the scroll unit 4. Therefore, such a structure in which the circular hole 31 is formed on the side of the movable scroll 3 and the pin 32 is protruding on the side of the front housing 7 is preferred like in the embodiment.

REFERENCE SYMBOL LIST

1 scroll-type compressor
2 fixed scroll
2*a* bottom plate
2*b* wrap (fixed scroll side)
2*c* bottom plate center (fixed scroll side)
2*d* spiral center (fixed scroll side)
3 movable scroll
3*a* bottom plate
3*b* wrap (movable scroll side)
3*c* bottom plate center (movable scroll side)
3*d* spiral center (movable scroll side)
4 scroll unit
5 fluid pocket (sealed space)
6 center housing
7 front housing
8 rear housing
9 suction chamber
13 discharge chamber

14 discharge hole
15 one-way valve
16 thrust plate
17 thrust receiving part
20 drive shaft
24 crank
25 eccentric bush
27 boss part
30 rotation-inhibiting mechanism
31 circular hole
32 pin
33 rotation-inhibiting part

The invention claimed is:

1. A scroll-type fluid machine comprising:

a scroll unit including a fixed scroll and a movable scroll, which respectively have a spiral wrap standing on a bottom plate with a spiral center of the wrap eccentric to a center of the bottom plate and which are meshed with respective wraps facing each other to form sealed spaces; and a rotation-inhibiting mechanism in which at least three or more rotation-inhibiting parts are arranged in a circumferential direction of the movable scroll, each rotation-inhibiting part being composed of a circular hole formed in either one of a back face of the bottom plate of the movable scroll and a housing wall facing the back face, and a pin protruding on the other in a form of being engaged with the circular hole, where while the rotation-inhibiting mechanism inhibit the rotation of the movable scroll, the movable scroll is orbited around a shaft center of the fixed scroll to change volumes of the sealed spaces, wherein in the rotation-inhibiting mechanism, at least one of the rotation-inhibiting parts is arranged to locate a center of the circular hole on a straight line extending perpendicularly to a straight line connecting the bottom plate center of the movable scroll and the spiral center of the wrap and passing through the bottom plate center.

2. The scroll-type fluid machine according to claim 1, wherein in the rotation-inhibiting mechanism, the straight line connecting the bottom plate center of the movable scroll and the spiral center of the wrap is rotated on the bottom plate center by 90° in a direction opposite to a wrapping direction of the wrap of the movable scroll, a point at which the rotated straight line intersects a pitch circle is set as a center position of one of the rotation-inhibiting parts, the pitch circle having the bottom plate center as a center and a length from the bottom plate center to a center of the circular hole as a radius, and the other rotation-inhibiting parts are arranged on the pitch circle at even intervals based on one of the rotation-inhibiting part.

3. The scroll-type fluid machine according to claim 1, wherein the circular hole is formed in the back face of the bottom plate of the movable scroll, and the pin is provided to protrude on the housing side.

4. The scroll-type fluid machine according to claim 1, wherein eccentricity of the bottom plate center of the movable scroll and the spiral center of the wrap is set to ⅓ or less of a turning radius of the movable scroll turning about the shaft center of the fixed scroll.

5. The scroll-type fluid machine according to claim 2, wherein the circular hole is formed in the back face of the bottom plate of the movable scroll, and the pin is provided to protrude on the housing side.

6. The scroll-type fluid machine according to claim 2, wherein eccentricity of the bottom plate center of the movable scroll and the spiral center of the wrap is set to ⅓ or less of a turning radius of the movable scroll turning about the shaft center of the fixed scroll.

7. The scroll-type fluid machine according to claim 3, wherein eccentricity of the bottom plate center of the movable scroll and the spiral center of the wrap is set to ⅓ or less of a turning radius of the movable scroll turning about the shaft center of the fixed scroll.

* * * * *